United States Patent [19]

Gross

[11] 4,286,239

[45] Aug. 25, 1981

[54] GAS-TIGHT, HIGH-FREQUENCY PERMEABLE WINDOW ARRANGEMENT IN A COAXIAL LINE, PARTICULARLY FOR TRAVELING WAVE TUBES

[75] Inventor: Franz Gross, Loerrach, Fed. Rep. of Germany

[73] Assignee: Siemens Aktiengesellschaft, Berlin & Munich, Fed. Rep. of Germany

[21] Appl. No.: 109,805

[22] Filed: Jan. 7, 1980

[30] Foreign Application Priority Data

Feb. 28, 1979 [DE] Fed. Rep. of Germany ..... 2907762

[51] Int. Cl.[3] ..... H01P 1/08; H01J 23/32

[52] U.S. Cl. ..... 333/245; 333/252

[58] Field of Search ..... 333/230, 245, 252; 315/39, 39.53

[56] References Cited

U.S. PATENT DOCUMENTS

| | | | |
|---|---|---|---|
| 3,058,074 | 10/1962 | Kane | 333/245 |
| 3,065,377 | 11/1962 | Eakin | 315/39.53 X |
| 3,327,257 | 6/1967 | Weiss | 333/245 |
| 3,448,331 | 6/1969 | Cook | 333/252 X |

FOREIGN PATENT DOCUMENTS 1591596 5/1970 Fed. Rep. of Germany .

*Primary Examiner*—Paul L. Gensler

*Attorney, Agent, or Firm*—Hill, Van Santen, Steadman, Chiara & Simpson

[57] ABSTRACT

A gas-tight, high-frequency permeable window arrangement in a coaxial line, particularly for traveling wave tubes, has a large pass band width as well as being mechanically and thermally stable. For this purpose, a hollow cylinder of dielectric material is provided between the coaxial line on the input side and the coaxial line on the output side, the hollow cylinder surrounding the inner conductor of the coaxial line on the input side and being connected with its one end face to the outer conductor of the coaxial line on the input side and being connected with its other end face to a flange which is arranged between the inner conductors of the coaxial lines of the input and output sides. A window arrangement constructed in accordance with the present invention is particularly suitable for employment in radio link traveling wave tubes.

5 Claims, 3 Drawing Figures

GAS-TIGHT, HIGH-FREQUENCY PERMEABLE WINDOW ARRANGEMENT IN A COAXIAL LINE, PARTICULARLY FOR TRAVELING WAVE TUBES

BACKGROUND OF THE INVENTION

1. Field of the Invention

The present invention relates to a gas-tight, high-frequency permeable window arrangement between a coaxial line on the input side and a coaxial line on the output side, particularly for traveling wave tubes.

2. Description of the Prior Art

A gas-tight high-frequency permeable window arrangement in a coaxial line, particularly for traveling wave tubes, is known from the German Letters Pat. No. 1,591,596 in which a dielectric support is provided through which the inner conductor of the coaxial line is extended having an exterior diameter which is smaller than the normal inner conductor diameter of the coaxial line, but which is greater than the reduced inner conductor diameter necessary in the area of the support for an adaptation of the surge impedance of the passage to the surge impedance of the line. In this window arrangement, the inner conductor is conically enlarged in the direction towards the support on both sides of the support. However, in this window arrangement, the dielectric support which, for example, can consist of ceramic material, is designed as a disc so that relatively high dielectric losses can occur, particularly given high-performance tubes, and the thermal load of the dielectric support which occurs can lead to its damage.

SUMMARY OF THE INVENTION

The object of the present invention is to create a gas-tight, high-frequency permeable window arrangement which exhibits a large pass band width and which is mechanically and thermally stable.

In order to achieve the foregoing object, according to the present invention, it is proposed to provide a gas-tight, high-frequency permeable window arrangement of the type generally mentioned above in which a hollow cylinder comprising dielectric material is provided between the coaxial line at the input side and the coaxial line at the output side, which hollow cylinder surrounds the inner conductor of the coaxial line on the input side and is connected with its one end face to the outer conductor of the coaxial line at the input side, and which is connected with its other end face to a flange which is arranged between the inner conductors of the coaxial lines of the input and output sides.

Preferably, a metallic compensation element which surrounds the inner conductor and the hollow cylinder is provided between the outer conductors of the coaxial lines on the input and output sides, the hollow cylinder advantageously comprising beryllium oxide, aluminum oxide or boron nitride.

By means of exploiting the shearing of the field lines, the dielectric load of the tube-shaped window arrangement is greatly reduced, so that $Al_2O_3$ can be employed as material for the hollow cylinder in addition to BeO and BN. The window arrangement is technically simple to manufacture and can be designed for large pass band widths. The arrangement constructed in accordance with the present invention is mechanically and thermally stable and has relatively large sealing surfaces. Thermal loads are not critical because of the small dimensions.

The window arrangement of the present invention can be compensated in a simple manner by means of cylindrical or conical turned parts.

The invention has the further advantage that, even given high-performance traveling wave tubes, the dielectric losses in the high-frequency permeable window are kept so low that a thermal or, respectively, mechanical load which is too high and, thus, a fracturing or, respectively, loss of seal the window is avoided.

BRIEF DESCRIPTION OF THE DRAWING

Other objects, features and advantages of the invention, its organization, construction and operation will be best understood from the following detailed description, taken in conjunction with the accompanying drawing, on which.

DESCRIPTION OF THE PREFERRED EMBODIMENTS

Figure 1:
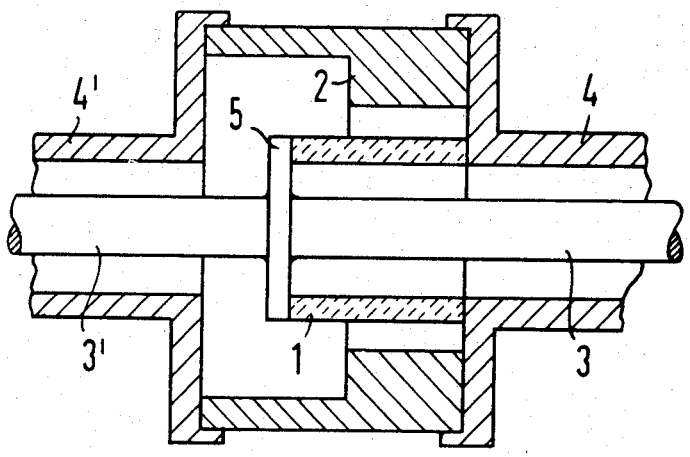
FIG. 1 is a longitudinal sectional view of a window arrangement constructed in accordance with the present invention.
Figure 2:
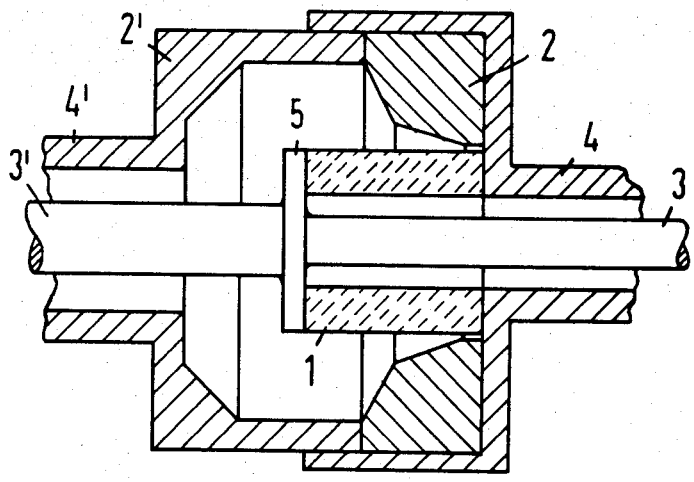
FIG. 2 is a longitudinal sectional view of another window arrangement constructed in accordance with the present invention.
Figure 3:
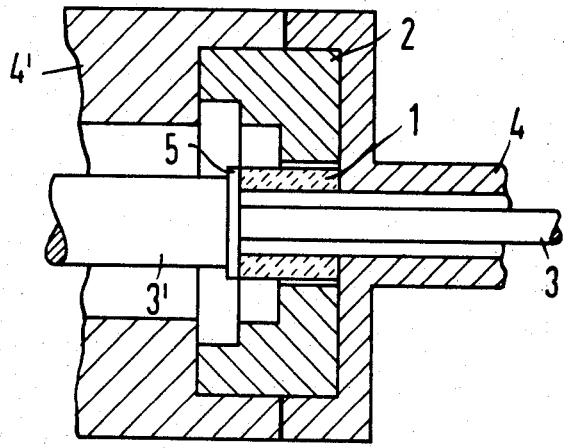
FIG. 3 is a longitudinal sectional view, of yet another embodiment of a window arrangement constructed in accordance with the present invention.

In the window arrangements illustrated on the drawing, an output coupled from the delay line of an amplifier (not illustrated) is supplied by way of a coaxial line 3, 4 to the input side of the window arrangement. The window arrangement comprises a hollow cylinder 1 comprising dielectric material whose one end face is soldered to the outer conductor 4 of the coaxial line 3, 4 at the input side. The other end face is soldered to a flange 5 which is soldered between the two inner conductors 3, 3' of the coaxial lines 3, 4, 3', 4', respectively, of the input and output sides. A metallic compensation element 2 is preferably provided between the two outer conductors 4, 4' of the coaxial lines 3, 4 and 3', 4' of the input and output sides, the compensation element 2 surrounding the inner conductor 3, 3' and the hollow cylinder 1 comprising dielectric material and, together with these elements, adapting the window arrangement to the coaxial connection lines over a broad frequency band without reflection ($r<10\%$ of, for example 2 GHz–8 GHz). Thereby, the compensation element can be of a stepped cylindrical shape as illustrated in FIGS. 1 and 3, or can be conical and comprise two parts 2, 2' as illustrated in FIG. 2.

Since the electric field lines only partially proceed in the dielectric and predominantly in error in the exemplary embodiments illustrated on the drawing, the dielectric load of the ceramic hollow cylinder is low, so that broad-band window arrangements can also be constructed with $Al_2O_3$ ($\epsilon=9$).

Although I have described my invention by reference to particular illustrative embodiments thereof, many changes and modifications thereof may become apparent to those skilled in the art without departing from the spirit and scope of the invention. I therefore intend to include within the patent warranted hereon all such changes and modifications as may reasonably and properly be included within the scope of my contribution to the art.

I claim:

1. A gas-tight window arrangement for connecting an input side coaxial line with inner and outer conductors to an output coaxial line with inner and outer conductors, comprising:

a hollow cylinder of dielectric material surrounding an end portion of the input inner conductor and including a first end face connected to the input outer conductor and a second end face; and a flange including a first face connected to the output inner conductor and a second face connected to the input inner conductor and to said second end face of said hollow cylinder.

2. The window arrangement of claim 1, comprising:

a metallic compensation element connected between said input and output outer conductors.

3. The window arrangement of claim 1, wherein said hollow cylinder comprises beryllium oxide.

4. The window arrangement of claim 1, wherein said hollow cylinder comprises aluminum oxide.

5. The window arrangement of claim 1, wherein said hollow cylinder comprises boron nitride.

* * * * *